US007553673B2

(12) United States Patent
Kinker et al.

(10) Patent No.: US 7,553,673 B2
(45) Date of Patent: Jun. 30, 2009

(54) QUALITY CONTROL OF A FUNCTIONAL FLUID

(75) Inventors: Bernard Kinker, Kintnersville, PA (US); Jen-Lung Wang, Collegeville, PA (US); Joan Souchik, Blue Beil, PA (US)

(73) Assignee: RohMax Additives GmbH, Darmstadt (DE)

( * ) Notice: Subject to any disclaimer, the term of this patent is extended or adjusted under 35 U.S.C. 154(b) by 0 days.

(21) Appl. No.: 11/559,009

(22) Filed: Nov. 13, 2006

(65) Prior Publication Data

US 2008/0113886 A1 May 15, 2008

(51) Int. Cl.
*G01N 33/28* (2006.01)

(52) U.S. Cl. ..... 436/60; 436/56

(58) Field of Classification Search ..... 526/79; 508/364, 183, 283, 448, 431; 252/68; 436/56
See application file for complete search history.

(56) References Cited

U.S. PATENT DOCUMENTS 4,194,985 A * 3/1980 Coleman ..... 508/448
4,579,672 A * 4/1986 Brecker et al. ..... 508/431
5,576,273 A * 11/1996 Karol et al. ..... 508/364
5,840,664 A * 11/1998 Karol et al. ..... 508/283
6,034,038 A 3/2000 Lockwood et al.
6,140,431 A * 10/2000 Kinker et al. ..... 526/79
2004/0144952 A1 * 7/2004 Stewart ..... 252/68

FOREIGN PATENT DOCUMENTS

DE 19739659 A1 3/1999
FR 2617180 * 12/1988
GB 1346770 * 2/1974

* cited by examiner

*Primary Examiner*—Walter D Griffin
*Assistant Examiner*—Christine T Mui
(74) *Attorney, Agent, or Firm*—Oblon, Spivak, McClelland, Maier & Neustadt, P.C.

(57) ABSTRACT

The present invention describes use of use of a metal compound to control the quality of a functional fluid. Additionally, the present invention concerns a method for controlling the quality of a functional fluid comprising the steps of:
adding a metal compound to a component of a lubricant;
mixing the component with a base oil;
measuring the concentration of the metal compound in the functional fluid; and
comparing the expected concentration of the metal compound with the measured concentration.

22 Claims, No Drawings

QUALITY CONTROL OF A FUNCTIONAL FLUID

The present invention relates to an improvement in quality control of a functional fluid and a method for controlling the quality of a functional fluid.

The production of functional fluids like hydraulic fluids or lubricants is a well known process. Generally, different components, e.g. a base fluid and additives, such as viscosity index improvers (VI), pour point depressants (PPD), detergent/inhibitor components (DI), are mixed in order to obtain a functional fluid. However, sometimes errors may occur and, therefore, the quality of the final product has to be controlled in addition to the quality control of each of the compounds used for the production of the functional fluid. Usually, the control is performed by complicated and expensive methods.

The use of tracers for assessment of a drilling well is disclosed in FR 2617180. The tracer is used to follow the results of well drilling not the quality of the drilling fluid. The document is silent about the quality control of a functional fluid.

Additionally, the use of compounds comprising metals in a functional fluid is known from numerous patents including U.S. Pat. No. 5,576,273 and US 2004144952. However, these compounds provide have an effect to the functional fluid. E.g. in U.S. Pat. No. 5,576,273 the organometallic compound is used to improve the extreme pressure characteristics of a lubricant composition. Numerous other organometallic compounds are added to lubricants. In all cases these are added to provide improvements to properties and not for assessment of quality.

Taking into consideration the prior art, it is an object of this invention to provide a simple and inexpensive method for controlling the quality of a functional fluid.

These as well as other not explicitly mentioned tasks, which, however, can easily be derived or developed from the introductory part, are achieved by the use of a metal compound according to the present invention. Expedient modifications of the use in accordance with the invention are described in the dependent claims.

The use of a metal compound provides an unexpected improvement in quality control of a functional fluid. By using at least one metal compounds the quality control of a functional fluid can be achieved in a simple and inexpensive manner.

At the same time a number of other advantages can be achieved through the use in accordance with the invention. Among these are:

The method can be performed in a very short time.

The method to control the fluid quality needs only a very small amount of fluid.

The method to control the fluid quality is simple. Consequently, the method can be performed in an automated manner or without highly skilled personnel.

The method of the present invention can be performed in the production of all kinds of functional fluids. These fluids include hydraulic fluids and/or lubricants. These fluids are well known in the art and are described, e.g., in Ulimann's Encyclopedia of Industrial Chemistry, 5th Edition on CD-ROM, 1997

Preferred functional fluids comprise at least a mineral oil and/or a synthetic oil and/or a biologically sourced oil.

Mineral oils axe well known in the art and commercially available. They are in general obtained from petroleum or crude oil by distillation and/or refining and optionally additional purification and processing methods, especially the higher-boiling fractions of crude oil or petroleum fall under the concept of mineral oil. In general, the boiling point of the mineral oil is higher than 200° C., preferably higher than 300° C., at 5000 Pa. Preparation by low temperature distillation of shale oil, coking of hard coal, distillation of lignite under exclusion of air as well as hydrogenation of hard coal or lignite is likewise possible.

Oils can also be produced from raw materials of plant origin (for example jojoba, rapeseed (canola), sunflower, and soybean oil) or animal origin (for example tallow or neatfoots oil). Accordingly, mineral oils exhibit different amounts of aromatic, cyclic, branched and linear hydrocarbons, in each case according to origin.

In general, one distinguishes paraffin-base, naphthenic and aromatic fractions in crude oil or mineral oil, where the term paraffin-base fraction stands for longer-chain or highly branched isoalkanes and naphthenic fraction stands for cycloalkanes. Moreover, mineral oils, in each case according to origin and processing, exhibit different fractions of n-alkanes, isoalkanes with a low degree of branching, so called monomethyl-branched paraffins, and compounds with heteroatoms, especially O, N and/or S, to which polar properties are attributed. However, attribution is difficult, since individual alkane molecules can have both long-chain branched and cycloalkane residues and aromatic components. For purposes of this invention, classification can be done in accordance with DIN 51 378, Polar components can also be determined in accordance with ASTM D 2007.

The fraction of n-alkanes in the preferred mineral oils is less than 5 wt %, and the fraction of O, N and/or S-containing compounds is less than 6 wt %. The fraction of aromatic compounds and monomethyl-branched paraffins is in general in each case in the range of 0-40 wt %. In accordance with one interesting aspect, mineral oil comprises mainly naphthenic and paraffin-base alkanes, which in general have more than 13, preferably more than 18 and especially preferably more than 20 carbon atoms. The fraction of these compounds is in general at least 60 wt %, preferably at least 80 wt %, without any limitation intended by this. A preferred mineral oil contains 0.5-30 wt % aromatic components, 15-40 wt % naphthenic components, 35-80 wt % paraffin-base components, up to 3 wt % n-alkanes and 0.05-5 wt % polar components, in each case with respect to the total weight of the mineral oil.

An analysis of especially preferred mineral oils, which was done with traditional methods such as urea dewaxing and liquid chromatography on silica gel, shows, for example, the following components, where the percentages refer to the total weight of the relevant mineral oil:

n-alkanes with about 18-31 C atoms: 0.7-1.0%,
low-branched alkanes with 18-31 C atoms: 1.0-8.0%,
aromatic compounds with 14-32 C atoms: 0.4-10.7%,
iso- and cycloalkanes with 20-32 C atoms: 60.7-82.4%,
polar compounds: 0.1-0.8%,
loss: 6.9-19.4%.

Valuable advice regarding the analysis of mineral oil as well as a list of mineral oils that have other compositions can be found, for example, in Ullmann's Encyclopedia of Industrial Chemistry, 5th Edition on CD-ROM, 1997, under the entry "lubricants and related products."

Preferably, the functional fluid is based on mineral oil from API Group I, II, and/or III or mixtures of these. According to a preferred embodiment of the present invention, a mineral oil containing at least 90% by weight saturates and at most about 0.03% sulfur measured by elemental analysis is used.

Synthetic oils are, among other substances, polyalphaolefins, organic esters like carboxylic esters and phosphate esters; organic ethers like silicone oils and polyalkylene glycol; and synthetic hydrocarbons, especially polyolefins. They are for the most part somewhat more expensive than the mineral oils, but they have advantages with regard to performance. For an explanation reference is made to the 5 API classes of base oil types (API: American Petroleum Institute).

American Petroleum Institute (API) Base Oil Classifications

| Base stock Group | Viscosity Index | Sulfur (weight %) | Saturates (weight %) |
|---|---|---|---|
| Group I | 80-120 | >0.03 | <90 |
| Group II | 80-120 | <0.03 | >90 |
| Group III | >120 | <0.03 | >90 |
| Group IV all synthetic Polyalphaolefins (PAO) | >120 | <0.03 | >99 |
| Group V all not included in Groups I-IV, e.g. esters, polyalkylene glycols | >120 | <0.03 | |

Synthetic hydrocarbons, especially polyolefins are well known in the art. Especially polyalphaolefins (PAO) are preferred. These compounds are obtainable by polymerization of alkenes, especially alkenes having 3 to 12 carbon atoms, like propene, hexene-1, octene-1, and dodecene-1. Preferred PAOs have a number average molecular weight in the range of 200 to 10000 g/mol, more preferably 500 to 5000 g/mol.

According to a preferred aspect of the present invention, the functional fluid may comprise an oxygen containing compound selected from the group of carboxylic acid esters, polyether polyols and/or organophosphorus compounds. Preferably, the oxygen containing compound is a carboxylic ester containing at least two ester groups, a diester of carboxylic acids containing 4 to 12 carbon atoms and/or a ester of a polyol. By using an oxygen containing compound as a basestock, the fire resistance of the functional fluid can be improved.

Phosphorus ester fluids can be used as a component of the functional fluid such as alkyl aryl phosphate ester; trialkyl phosphates such as tributyl phosphate or tri-2-ethylhexyl phosphate; triaryl phosphates such as mixed isopropylphenyl phosphates, mixed t-butylphenyl phosphates, trixylenyl phosphate, or tricresylphosphate. Additional classes of organophosphorus compounds are phosphonates and phosphinates, which may contain alkyl and/or aryl substituents, Dialkyl phosphonates such as di-2-ethylhexylphosphonate; alkyl phosphinates such as di-2-ethylhexylphosphinate are useful. As the alkyl group herein, linear or branched chain alkyls comprising 1 to 10 carbon atoms are preferred. As the aryl group herein, aryls comprising 6 to 10 carbon atoms that may be substituted by alkyls are preferred. Especially, the functional fluids may contain 0 to 60% by weight, preferably 5 to 50% by weight organophosphorus compounds.

As the carboxylic acid esters reaction products of alcohols such as polyhydric alcohol or monohydric alcohol, and fatty acids such as mono carboxylic acid Or poly carboxylic acid can be used. Such carboxylic acid esters can of course be a partial ester.

Carboxylic acid esters may have one carboxylic ester group having the formula R—COO—R, wherein R is independently a group comprising 1 to 40 carbon atoms. Preferred ester compounds comprise at least two ester groups. These compounds may be based on poly carboxylic acids having at least two acidic groups and/or polyols having at least two hydroxyl groups.

The poly carboxylic acid residue usually has 2 to 40, preferably 4 to 24, especially 4 to 12 carbon atoms. Useful polycarboxylic acids esters are, e.g., esters of adipic, azelaic, sebacic, phthalate and/or dodecanoic acids. The alcohol component of the polycarboxylic acid compound preferably comprises 1 to 20, especially 2 to 10 carbon atoms.

Examples of useful alcohols are methanol, ethanol, propanol, butanol, pentanol, hexanol, heptanol and octanol. Furthermore, oxoalcohols can be used such as diethylene glycol, triethylene glycol, tetraethylene glycol up to decamethylene glycol.

Especially preferred compounds are esters of polycarboxylic acids with alcohols comprising one hydroxyl group. Examples of these compounds are described in Ullmanns Encyclopädie der Technisehen Chemie, third edition, vol. 15, page 287-292, Urban & Schwarenber (1964)).

Useful polyols to obtain ester compounds comprising at least two ester groups contain usually 2 to 40, preferably 4 to 22 carbon atoms. Examples are neopentyl glycol, diethylene glycol, dipropylene glycol, 2,2-dimethyl-3-hydroxypropyl-2',2'-dimethyl-3'-hydroxy propionate, glycerol, trimethylolethane, trimethanol propane, trimethylolnonane, ditrimethylolpropane, pentaerythritol, sorbitol, mannitol and dipentaerythritol. The carboxylic acid component of the polyester may contain 1 to 40, preferably 2 to 24 carbon atoms. Examples are linear or branched saturated fatty acids such as formic acid, acetic acid, propionic acid, octanoic acid, caproic acid, enanthic acid, caprylic acid, pelargonic acid, capric acid, undecanoic acid, lauric acid, tridecanoic acid, myrisric acid, pentadecanoic acid, palmitic acid, heptadecanoic acid, stearic acid, nonadecanoic acid, arachic acid, behenic acid, isomyiristic acid, isopalmitic acid, isostearic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetra-ethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid, 3,5,5-trimethylhexanoic, acid; linear or branched unsaturated fatty such as linoleic acid, linolenic acid, 9 octadecenoic acid, undecanoic acid, elaidic acid, cetoleic acid, erucic acid, brassidic acid, and commercial grades of oleic acid from a variety of animal fat or vegetable oil sources. Mixtures of fatty acids such as tall oil fatty acids can be used.

Especially useful compounds comprising at least two ester groups are, e.g., neopentyl glycol tallate, neopentyl glycol dioleate, propylene glycol tallate, propylene glycol dioleate, diethylene glycol tallate, and diethylene glycol dioleate.

Many of these compounds are commercially available from Inolex Chemical Co. under the trademark Lexolube 2G-214, from Cognis Corp. under the trademark ProEco 2965, from Uniqema Corp. under the trademarks Priolube 1430 and Priolube 1446 and from Georgia Pacific under the trademarks Xtolube 1301 and Xtolube 1320.

Furthermore, ethers are useful as a component of the functional fluid. Preferably, polyether polyols are used as a component of the functional fluid of the present invention, These compounds are well known. Examples are polyalkylene glycols like, e.g., polyethylene glycols, polypropylene glycols and polybutylene glycols. The polyalkylene glycols can be based on mixtures of alkylene oxides. These compounds preferably comprise 1 to 40 alkylene oxide units, more preferably 5 to 30 alkylene oxide units. Polybutylene glycols are preferred compounds for anhydrous fluids. The polyether polyols may comprise further groups, like e.g., alkylene or arylene groups comprising 1 to 40, especially 2 to 22 carbon is atoms.

According to another aspect of the present invention, the functional fluid can be based on a synthetic basestock comprising polyalphaolefin (PAO), carboxylic esters (diester, or polyol ester), a vegetable ester, phosphate ester (trialkyl, triaryl, or alkyl aryl phosphates), and/or polyalkylene glycol (PAG). Preferred synthetic basestocks are API Group IV and/or Group V oils. Additionally, these synthetic materials may also be mixed with mineral or biologically based oils as desired.

According to the present invention a metal compound is used in order to improve the quality control of a functional fluid. Preferably, the metal compound is not otherwise present in the functional fluid. The metal compound should have no detrimental effect to the functional fluid or to the equipment hardware in which the functional fluid is used. Furthermore, the metal compound should be soluble in the functional fluid in an amount sufficient to control the quality.

Useful metal compounds comprises Bismuth (Bi), Cesium (Cs), Cobalt (Co), Manganese (Mn), Neodymium (Nd), Nickel (Ni), Strontium (Sr), Titanium (Ti) and/or Zirconium (Zr).

The metal compounds usually comprise groups being able to solvate the metal compounds in the functional fluid. Accordingly, these groups depend on the specific components of the functional fluid, such as a base oil etc. In order to control the quality of a functional fluid comprising a mineral oil, a metal compound is used being soluble in a mineral oil.

According to an aspect of the present invention, the metal compound may be a compound according to the formula (I)

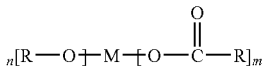

(I)

wherein M is a metal atom, R is an alkyl group having 8 to 30 carbon atoms, preferably 8 to 18 carbon atoms, where the residues R together can form a ring, n is an integer from 0 to 4, and m is an integer from 0 to 4, wherein n+m is at least 1, preferably 2 to 4, and more preferably about 4. The alkyl group in formula (I) R can be linear, branched, cyclic, saturated or unsaturated. Furthermore, the alkyl group R can be unsubstituted or substituted with, e.g. halogens or amino groups.

Useful alkyl groups include e.g. n-octyl, 2-ethylhexyl, 2-tert-butylheptyl, 3-isopropylheptyl nonyl, decyl, undecyl, 5-methylundecyl, dodecyl, 2-methyldodecyl, tridecyl, 5-methyltridecyl, tetradecyl, pentadecyl, 2-methylhexadecyl, heptadecyl, 5-isopropylheptadecyl, 4-tert-butyloctadecyl, 5-ethyloctadccyl, 3-isopropyloctadecyl, octadecyl, nonadecyl, eicosyl, cetyleicosyl, stearyleicosyl, docosyl, and/or eicosyltetratriacontyl.

Specific compounds are, e.g. nickel stearate, bismuth octoate, cesium stearate, titanium stearate, cobalt hexadecanoate, strontium octanolate, titanium octanolate and/or titanium 2-ethylhexyl oxide.

According to a further aspect of the present invention, polymers having chelating groups can be used as a group to solvate the metal atom or ion. E.g. polymers having repeating units being derived from monomers comprising hetero atoms such as oxygen and/or nitrogen can be used to complex the metal atoms and/or ions. These monomers include, e.g., acrylic acid, methacrylic acid, fumaric acid, maleic acid, vinyl alcohol, hydroxyalkyl (meth)acrylates, aminoalkyl (meth)acrylates and aminoalkyl(meth)acrylamides, (meth) acrylates of ether alcohols, heterocyclic (meth)acrylates and heterocyclic vinyl compounds, as mentioned below.

Preferably, the polymer to solvate the metal may have a weight average molecular weight in the range of 5000 to 1000000 g/mol, more preferably 10000 to 500000 g/mol and more preferably 25000 to 250000 g/mol. The weight average molecular weight can be determined by usual methods like gel permeation chromatography (GPC).

The amount of metal and metal compound, respectively, should be high enough to provide a reliable detection of the metal in the functional fluid. On the other hand, a very high treating rate may influence the performance of the functional fluid.

Preferably, the amount of metal in the functional fluid to control the quality of the functional fluid ranges from 5 to 1000 ppm, more preferably 10 to 500 ppm and more preferably 20 to 250 ppm. The amount of metal in the functional fluid can be determined by spectroscopic methods, like X-Ray Fluorescence (XRF) and inductively Couples Plasma (ICP) Spectroscopy.

Preferably, the amount of metal compound added to the functional fluid in order to control the quality ranges from 0.00001% by weight to 0.01% by weight, more preferably 0.0001 to 0.001% by weight.

The metal compound can be used as a single compound comprising one kind of metal. Furthermore, the metal compound can be used as a mixture of different compounds. Especially, a mixture of two, tree or more compounds having different kind of metals can be used in order to improve the quality control of a functional fluid.

Preferably, the functional fluid is obtainable by mixing at least two components. At least one of the components shall be a base oil as mentioned above.

Preferably, the functional fluid comprises at least one polymer. Preferred polymers useful in functional fluids like lubricants and/or hydraulic fluids are well known in the art.

If a polymer is used, preferably the polymer has a weight average molecular weight in the range of 5,000 to 1,000,000 g/mol, more preferably 10,000 to 500,000 g/mol and more preferably 25,000 to 250,000 g/mol. The weight average molecular weight can be determined by usual methods like gel permeations chromatography (GPC).

These polymers are used, e.g., as viscosity index improver (VI) and/or a pour point depressant (PPD).

The functional fluid may comprise 0.1 to 50% by weight, especially 0.5 to 30% by weight, and preferably 1 to 20% by weight, based on the total weight of the fluid, of one or more polymers.

Viscosity index improvers and pour point depressants are well known and, e.g. disclosed in Ullmann's Encyclopedia of Industrial Chemistry, 5th Edition on CD-ROM, 1997.

Preferred polymers useful as VI improvers and/or pour point depressants comprise units derived from alkyl esters having at least one ethylenically unsaturated group. These polymers are well known in the art. Preferred polymers are obtainable by polymerizing, in particular, (meth)acrylates, maleates and fumarates. The term (meth)acrylates includes methacrylates and acrylates as well as mixtures of the two. These monomers are well known in the art. The alkyl residue can be linear, cyclic or branched.

Mixtures to obtain preferred polymers comprising units derived from alkyl esters contain 0 to 100 wt %, preferably 0.5 to 90 wt %, especially 1 to 80 wt %, more preferably 1 to 30 wt %, more preferably 2 to 20 wt % based on the total weight of the monomer mixture of one or more ethylenically unsaturated ester compounds of formula (II)

(II)

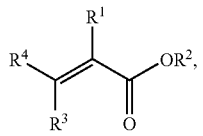

Where $R^1$ is hydrogen or methyl, $R^2$ means a linear or branched alkyl residue with 1-6 carbon atoms, especially 1 to 5 and preferably 1 to 3 carbon atoms, $R^3$ and $R^4$ independently represent hydrogen or a group of the formula —COOR', where R' means hydrogen or a alkyl group with 1-6 carbon atoms.

Examples of component (a) are, among others, (meth) acrylates, fumarates and maleates, which derived from saturated alcohols such as methyl(meth)acrylate, ethyl(meth) acrylate, n-propyl(meth)acrylate, isopropyl(meth)acrylate, n-butyl(meth)acrylate, tert-butyl (meth)acrylate, pentyl (meth)acrylate and hexyl(meth)acrylate; cycloalkyl(meth) acrylates, like cyclopentyl(meth)acrylate.

Furthermore, the monomer compositions to obtain the polymers comprising units derived from alkyl esters contain 0-100 wt %, preferably 10-99 wt %, especially 20-95 wt % and more preferably 30 to 85 wt % based on the total weight of the monomer mixture of one or more ethylenically unsaturated ester compounds of formula (III)

(III)

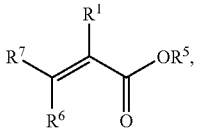

where $R^1$ is hydrogen or methyl, $R^5$ means a linear or branched alkyl residue with 7-40, especially 10 to 30 and preferably 12 to 24 carbon atoms, $R^6$ and $R^7$ are independently hydrogen or a group of the formula —COOR", where R" means hydrogen or an alkyl group with 7 to 40, especially 10 to 30 and preferably 12 to 24 carbon atoms.

Among these are (meth)acrylates, fumarates and maleates that derive from saturated alcohols, such as 2-ethylhexyl (meth)acrylate, heptyl(meth)acrylate, 2-tert-butylheptyl (meth)acrylate, octyl(meth)acrylate, 3-isopropylheptyl (meth)acrylate, nonyl (meth)acrylate, decyl(meth)acrylate, undecyl(meth)acrylate, 5-methylundecyl (meth)acrylate, dodecyl(meth)acrylate, 2-methyldodecyl(meth)acrylate, tridecyl (meth)acrylate, 5-methyltridecyl(meth)acrylate, tetradecyl(meth)acrylate, pentadecyl (meth)acrylate, 2-methylhexadecyl(meth)acrylate, heptadecyl(meth)acrylate, 5-isopropylheptadecyl(meth)acrylate, 4-tert-butyloctadecyl (meth)acrylate, 5-ethyloctadecyl (meth)acrylate, 3-isopropyloctadecyl(meth)acrylate, octadecyl(meth)acrylate, nonadecyl (meth)acrylate, eicosyl(meth)acrylate, cetyleicosyl(meth)acrylate, stearyleicosyl (meth)acrylate, docosyl(meth)acrylate, and/or eicosyltetratriacontyl(meth) acrylate;

cycloalkyl(meth)acrylates such as 3-vinylcyclohexyl (meth)acrylate, cyclohexyl (meth)acrylate, bornyl(meth) acrylate, 2,4,5-tri-t-butyl-3-vinylcyclohexyl(meth)acrylate, 2,3,4,5-tetra-t-butylcyclohexyl(meth)acrylate; and the corresponding fumarates and maleates.

The ester compounds with a long-chain alcohol residue, especially component (b), can be obtained, for example, by reacting (meth)acrylates, fumarates, maleates and/or the corresponding acids with long chain fatty alcohols, where in general a mixture of esters such as (meth)acrylates with different long chain alcohol residues results. These fatty alcohols include, among others, Oxo Alcohol® 7911 and Oxo Alcohol® 7900, Oxo Alcohol® 1100 (Monsanto); Alphanol® 79 (ICI); Nafol® 1620, Alfol® 610 and Alfol® 810 (Sasol); Epal® 610 and Epal® 810 (Ethyl Corporation); Linevol® 79, Linevol® 911 and Dobanol® 25L (Shell AG); Lial 125 (Sasol); Dehydad® and Dehydad® and Lorol® (Cognis). Of the ethylenically unsaturated ester compounds, the (meth)acrylates are particularly preferred over the maleates and furmarates, i.e., $R^3$, $R^4$, $R^6$, $R^7$ of formulas (II) and (III) represent hydrogen in particularly preferred embodiments.

In a particular aspect of the present invention, preference is given to using mixtures of ethylenically unsaturated ester compounds of formula (III), and the mixtures have at least one (meth)acrylate having from 7 to 15 carbon atoms in the alcohol radical and at least one (meth) acrylate having from L 6 to 30 carbon atoms in the alcohol radical. The fraction of the (meth)acrylates having from 7 to 15 carbon atoms in the alcohol radical is preferably in the range from 20 to 95% by weight, based on the weight of the monomer composition for the preparation of polymers. The fraction of the (meth)acrylates having from 16 to 30 carbon atoms in the alcohol radical is preferably in the range from 0.5 to 60% by weight based on the weight of the monomer composition for the preparation of the polymers comprising units derived from alkyl esters. The weight ratio of the (meth)acrylate having from 7 to 15 carbon atoms in the alcohol radical and the (meth) acrylate having from 16 to 30 carbon atoms in the alcohol radical is preferably in the range of 10:1 to 1:10, more preferably in the range of 5:1 to 1.5:1.

Component (e) comprises in particular ethylenically unsaturated monomers that can copolymerize with the ethylenically unsaturated ester compounds of formula (II) and/or (III).

Comonomers that correspond to the following formula are especially suitable for polymerization in accordance with the invention:

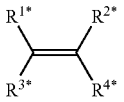

where R1* and R2* independently are selected from the group consisting of hydrogen, halogens, CN, linear or branched alkyl groups with 1-20, preferably 1-6 and specially preferably 1-4 carbon atoms, which can be substituted with 1 to (2n+1) halogen atoms, where n is the number of carbon atoms of the alkyl group (for example CF3), α, β-unsaturated linear or branched alkenyl or alynyl groups with 2-10, preferably 2-6 and especially preferably 2-4 carbon atoms, which can be substituted with 1 to (2n−1) halogen atoms, preferably chlorine, where n is the number of carbon atoms of the alkyl group, for example $C_2{=}CCl$—, cycloalkyl groups with 3-8 carbon atoms, which can be substituted with 1 to (2n−1) halogen atoms, preferably chlorine, where n is the number of carbon atoms of the cycloalkyl group; C(=Y*)R5*, C(=Y*)$NR^{6*}R^{7*}$, Y*C(=Y*)$R^{5*}$, $SOR^{5*}$, $SO_2R^{5*}$, $OSO_2R^{5*}$, $NR^{8*}SO_2R^{5*}$, $PR^{5*}{}_2$, P(=Y*)$R^{5*}{}_2$, Y*$PR^{5*}{}_2$, Y*P(=Y*)

$R^{5*}_2$, $NR^{8*}_2$, which can be quaternized with an additional $R^{8*}$, aryl, or heterocyclyl group, where Y* can be $NR^{8*}$, S or O, preferably O; $R^{5*}$ is an alkyl group with 1-20 carbon atoms, an alkylthio group with 1-20 carbon atoms, $OR^{15}$ ($R^{15}$ is hydrogen or an alkali metal), alkoxy with 1-20 carbon atoms, aryloxy or heterocyclyloxy; $R^{6*}$ and $R^{7*}$ independently are hydrogen or an alkyl group with one to 20 carbon atoms, or $R^{6*}$and $R^{7*}$ together can form an alkylene group with 2-7, preferably 2-5 carbon atoms, where they form a 3-8 member, preferably 3-6 member ring, and $R^{8*}$ is linear or branched alkyl or aryl groups with 1-20 carbon atoms;

R3* and R4* independently are chosen from the group consisting of hydrogen, halogen (preferably fluorine or chlorine), alkyl groups with 1-6 carbon atoms and $COOR^{9*}$, where $R^{9*}$ is hydrogen, an alkali metal or an alkyl group with 1-40 carbon atoms, or $R^{1*}$ and $R^{3*}$ can together form a group of the formula $(CH_2)_{n'}$, which can be substituted with 1-2n' halogen atoms or $C_1$-$C_4$ alkyl groups, or can form a group of the formula C(═O)—Y*—C(═O), where n' is from 2-6, preferably 3 or 4, and Y* is defined as before; and where at least 2 of the residues $R^{1*}$, $R^{2*}$, $R^{3*}$ and $R^{4*}$ are hydrogen or halogen.

The comonomers include, among others, hydroxyalkyl (meth)acrylates like 3-hydroxypropyl(meth)acrylate, 3,4-dihydroxybutyl(meth)acrylate, 2-hydroxyethyl (meth)acrylate, 2-hydroxypropyl(meth)acrylate, 2,5-dimethyl-1,6-hexanediol (meth)acrylate, 1,10-decanediol (meth)acrylate;

aminoalkyl(meth)acrylates and aminoalkyl(meth)acrylamides like N-(3-dimethylaminopropyl)methacrylamide, 3-diethylaminopentyl(meth)acrylate, 3-dibutylaminohexadecyl(meth)acrylate;

nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth)acrylate;

aryl(meth)acrylates like benzyl(meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl (meth)acrylate, oxazolidinylethyl(meth)acrylate, N-methyacryloyloxy)formamide, acetonyl(meth)acrylate, N-methacryloylmorpholine, N-methacryloyl-2-pyrrolidinone, N-(2-methyacryloxyoxyethyl)-2-pyrrolidinone, N-(3-methacryloyloxypropyl)-2-pyrrolidinone, N-(2-methyacryloyloxypentadecyl(-2-pyrrolidinone, N-(3-methacryloyloxyheptadecyl-2-pyrrolidinone;

(meth)acrylates of ether alcohols like tetrahydrofurfuryl (meth)acrylate, vinyloxyethoxyethyl (meth)acrylate, methoxyethoxyethyl(meth)acrylate, 1-butoxypropyl (meth)acrylate, 1-methyl-(2-vinyloxy)ethyl(meth)acrylate, cyclohexyloxymethyl (meth)acrylate, methoxymethoxyethyl(meth)acrylate, benzyloxymethyl (meth)acrylate, furfuryl(meth)acrylate, 2-butoxyethyl (meth)acrylate, 2-ethoxyethoxymethyl (meth)acrylate, 2-ethoxyethyl(meth)acrylate, ethoxylated (meth)acrylates, allyloxymethyl (meth)acrylate, 1-ethoxybutyl (meth)acrylate, methoxymethyl(meth)acrylate, 1-ethoxyethyl(meth)acrylate, ethoxymethyl(meth)acrylate;

(meth)acrylates of halogenated alcohols like 2,3-dibromopropyl(meth)acrylate, 4-bromophenyl(meth)acrylate, 1,3-dichloro-2-propyl(meth)acrylate 2-bromoethyl (meth)acrylate, 2-iodoethyl(meth)acrylate, chloromethyl(meth)acrylate; oxiranyl(meth)acrylate like 2,3-epoxybutyl(meth)acrylate, 3,4-epoxybutyl(meth)acrylate, 10,11 epoxyundecyl(meth)acrylate, 2,3-epoxycyclohexyl(meth)acrylate, oxiranyl (meth)acrylates such as 10,11-epoxyhexadecyl(meth)acrylate, glycidyl(meth) acrylate;

phosphorus-, boron- and/or silicon-containing (meth)acrylates like 2-(dimethylphosphato)propyl(meth)acrylate, 2-(ethylphosphito)propyl(meth)acrylate, 2 dimethylphosphinomethyl(meth)acrylate, dimethylphosphonoethyl(meth)acrylate, diethylmethacryloyl phosphonate, dipropylmethacryloyl phosphates 2-(dibutylphosphono)ethyl(meth)acrylate, 2,3-butylenemethacryloylethyl borate, methyldiethoxymethacryloylethoxysiliane, diethylphosphatoethyl(meth)acrylate;

sulfur-containing (meth)acrylates like ethylsulfinylethyl (meth)acrylate, 4-thiocyanatobutyl (meth)acrylate, ethylsulfonylethyl(meth)acrylate, thiocyanatomethyl (meth)acrylate, methylsulfinylmethyl (meth)acrylate, bis(methacryloyloxyethyl)sulfide;

heterocyclic (meth)acrylates like 2-(1-imidazolyl)ethyl (meth)acrylate, 2-(4-morpholinyl)ethyl(meth)acrylate and 1-(2-methacryloyloxyethyl)-2-pyrrolidone;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as α-methylstyrene and α-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidone, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid derivatives such as maleic anhydride, methylmaleic anhydride, maleinimide, methylmaleinimide;

fumaric acid and fumaric acid derivatives such as, for example, mono- and diesters of fumaric acid.

Monomers that have dispersing functionality can also be used as comonomers. These monomers are well known in the art and contain usually hetero atoms such as oxygen and/or nitrogen. For example the previously mentioned hydroxyalkyl(meth)acrylates, aminoalkyl (meth)acrylates and aminoalkyl(meth)acrylamides, (meth)acrylates of ether alcohols, heterocyclic (meth)acrylates and heterocyclic vinyl compounds are considered as dispersing comononers.

Especially preferred mixtures contain methyl methacrylate, lauryl methacrylate and/or stearyl methacrylate.

The monomers can be used individually or as mixtures.

The functional fluid of the present invention preferably comprises polyalkylmethacrylate polymers. These polymers obtainable by polymerizing compositions comprising alkylmethacrylate monomers are well known in the art. Preferably, these polyalkylmethacrylate polymers comprise at least 40% by weight, especially at least 50% by weight, more preferably at least 60% by weight and most preferably at least 80% by weight methacrylate repeating units. Preferably, these polyalkylmethacrylate polymers comprise $C_9$-$C_{24}$ methacrylate repeating units and $C_1$-$C_8$ methacrylate repeating units.

The molecular weight of the polymers derived from alkyl esters is not critical. Usually the polymers derived from alkyl esters have a molecular weight in the range of 5,000 to 1,000,000 g/mol, preferably in the range of range of 10,000 to 200,000 g/mol and more preferably in the range of 25,000 to 100,000 g/mol, without any limitation intended by this. These values refer to the weight average molecular weight of the polymers.

Without intending any limitation by this, the alkyl(meth) acrylate polymers exhibit a polydispersity, given by the ratio of the weight average molecular weight to the number average molecular weight Mw/Mn, in the range of 1 to 15, preferably 1.1 to 10, especially preferably 1.2 to 5. The polydispersity may be determined by gel permeation chromatography (GPC).

The monomer mixtures described above can be polymerized by any known method. Conventional radical initiators can be used to perform a classic radical polymerization, These initiators are well known in the art. Examples for these radical initiators are azo initiators like 2,2'-azodiisobutyronitrile (AIBN), 2,2'-azobis(2-methylbutyronitrile) and 1,1 azobiscyclohexane carbonitrile; peroxide compounds, e.g. methyl ethyl ketone peroxide, acetyl acetone peroxide, dilauryl peroxide, tert.-butyl per-2-ethyl hexanoate, ketone peroxide, methyl isobutyl ketone peroxide, cyclohexanone peroxide, dibenzoyl peroxide, tert.-butyl perbenzoate, tert.-butyl peroxy isopropyl carbonate, 2,5-bis(2-ethylhexanoyl-peroxy)-2,5-dimethyl hexane, tert.-butyl peroxy 2-ethyl hexanoate, tert.-butyl peroxy-3,5,5-trimethyl hexanoate, dicumene peroxide, 1,1 bis(tert.butyl peroxy)cyclohexane, 1,1 bis(tert.butyl peroxy)3,3,5-trimethyl cyclohexane, cumene hydroperoxide and tert.-butyl hydroperoxide.

Low molecular weight poly(meth)acrylates can be obtained by using chain transfer agents. This technology is ubiquitously known and practiced in the polymer industry and is described in Odian, Principles of Polymerization, 1991. Examples of chain transfer agents are sulfur containing compounds such as thiols, e.g. n- and t-dodecanethiol, 2-mercaptoethanol, and mercapto carboxylic acid esters, e.g. methyl-3-mercaptopropionate. Preferred chain transfer agents contain up to 20, especially up to 15 and more preferably up to 12 carbon atoms. Furthermore, chain transfer agents may contain at least 1, especially at least 2 oxygen atoms.

Furthermore, the low molecular weight poly(meth)acrylates can be obtained by using transition metal complexes, such as low spin cobalt complexes. These technologies are well known and for example described in USSR patent 940,487-A and by Heuts, et al., Macromolecules 1999, pp 2511-519 and 3907-3912.

Furthermore, novel polymerization techniques such as ATRP (Atom Transfer Radical Polymerization) and or RAFT (Reversible Addition Fragmentation Chain Transfer) can be applied to obtain useful polymers derived from alkyl esters. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRRP explained above to which reference is expressly made for purposes of the disclosure. The RAFT method is extensively presented in WO 98/01478, for example, to which reference is expressly made for purposes of the disclosure.

The polymerization can be carried out at normal pressure, reduced pressure or elevated pressure. The polymerization temperature is also not critical. However, in general it lies in the range of −20-200° C., preferably 0-130° C. and especially preferably 60-120° C., without any limitation intended by this.

The polymerization can be carried out with or without solvents. The term solvent is to be broadly understood here.

According to a preferred embodiment, the polymer is obtainable by a polymerization in API Group II or Group III mineral oil. These solvents are disclosed above.

Furthermore, polymers obtainable by polymerization in a polyalphaolefin (PAO) are preferred. More preferably, the PAO has a number average molecular weight in the range of 200 to 10000, more preferably 500 to 5000. This solvent is disclosed above, The functional fluid may comprise 0.1 to 50% by weight, especially 0.5 to 30% by weight, and preferably 1 to 20% by weight, based on the total weight of the fluid, of one or more polymers derived from alkyl esters.

Another class of polymers useful in functional fluids are polyolefins. These polyolefins include in particular polyolefin copolymers (OCP) and hydrogenated styrene/diene copolymers (HSD). The polyolefin copolymers (OCP) to be used according to the invention are known per se. They are primarily polymers synthesized from ethylene, propylene, isoprene, butylene and/or further olefins having 5 to 20 carbon atoms. Systems which have been grafted with small amounts of oxygen- or nitrogen-containing monomers (e.g. from 0.05 to 5% by weight of maleic anhydride) may also be used. The copolymers which contain diene components are generally hydrogenated in order to reduce the oxidation sensitivity and the crosslinking tendency of the viscosity index improvers.

The molecular weight Mw of the polyolefins is in general from 10 000 to 300 000, preferably between 50 000 and 150 000. Such olefin copolymers are described, for example, in the German Laid-Open Applications DE-A 16 44 941, DE-A 17 69 834, DE-A 19 39 037, DE-A 19 63 039, and DE-A20 59 981.

Ethylene/propylene copolymers are particularly useful and terpolymers having the known ternary components, such as ethylidene-norbornene (cf. Macromolecular Reviews, Vol. 10 (1975)) are also possible, but their tendency to crosslink must also be taken into account in the aging process. The distribution may be substantially random, but sequential polymers comprising ethylene blocks can also advantageously be used. The ratio of the monomers ethylenepropylene is variable within certain limits, which can be set to about 75% for ethylene and about 80% for propylene as an upper limit, Owing to its reduced tendency to dissolve in oil, polypropylene is less suitable than ethylene/propylene copolymers. In addition to polymers having a predominantly atactic propylene incorporation, those having a more pronounced isotactic or syndiotactic propylene incorporation may also be used.

Such products are commercially available, for example under the trade names Dutral® CO 034, Dutral® CO 038, Dutral® CO 043, Dutral® CO 058, Buna® EPG 2050 or Buna® EPG 5050.

The hydrogenated styrene/diene copolymers (HSD) are likewise known, these polymers being described, for example, in DE 21 56 122. They are in general hydrogenated isoprene/styrene or butadiene/styrene copolymers. The ratio of diene to styrene is preferably in the range from 2:1 to 1:2, particularly preferably about 55:45. The molecular weight Mw is in general from 10000 to 300 000, preferably between 50000 and 150000. According to a particular aspect of the present invention, the proportion of double bonds after the hydrogenation is not more than 15%, particularly preferably not more than 5%, based on the number of double bonds before the hydrogenation.

Hydrogenated styrene/diene copolymers can be commercially obtained under the trade name SHELLVIS® 50, 150, 200, 250 or 260.

According to a preferred aspect of the present invention, the fluid may comprise at least two polymers having a different monomer composition. Preferably, at least one of the polymers is a polyolefin and/or a polymer derived from alkyl esters.

Preferably, at least one of the polymers of the mixture comprises units derived from monomers selected from acrylate monomers, methacrylate monomers, fumarate monomers and/or maleate monomers. These polymers are described above.

The weight ratio of the polyolefin and the polymer comprises Units derived from, monomers selected from acrylate monomers, methacrylate monomers, fumarate monomers and/or maleate monomers may be in the range of 1:10 to 10:1, especially 1:5 to 5:1.

Furthermore, the present invention provides a method for controlling the quality of a functional fluid comprising the steps of:

adding a metal compound to a component of a functional fluid;

mixing the component with a base oil;

measuring the concentration of the metal compound in the functional fluid; and comparing the expected concentration of the metal compound with the measured concentration.

In the present invention, the quality control can be achieved by using a metal compound as a tracer. Usually, the functional fluids are produced by adding different additives, like viscosity index improvers, pour point depressants, and a detergent-inhibitor package or separate detergent-inhibitor components, etc. to a base oil. These additives allow an adaptation of a base fluid to the needs of the customers. However, there are many different additives, as mentioned above, and, therefore, in prior art quality control was achieved by performing expensive tests. In contrast thereto, the present invention allows the control of the quality by determination of a specific metal compound being present in a specific additive.

Preferably, least two different components are added to a base oil comprising different metal compounds. Using different metal compounds in the different additives of a functional fluid allows an assessment of the overall quality of a functional fluid.

The functional fluid of the present invention may comprise further additives well known in the art such as viscosity index improvers, antioxidants, anti-wear agents, corrosion inhibitors, detergents, dispersants, BP additives, defoamers, friction reducing agents, pour point depressants, dyes, odorants and/or demulsifiers. These additives are used in conventional amounts. Usually the functional fluids contain 0 to 50% by weight, preferably 0.1 to 20% by weight and more preferably 0.2 to 10% by weight additives.

The functional fluid of the present invention has good low temperature performance. The low temperature performance can be evaluated by numerous well known methods including Mini Rotary Viscometer according to ASTM D 4684 and the Brookfield viscometer according to ASTM D 2983.

The functional fluids of the present invention are useful e.g. in industrial, automotive, mining, power generation, marine and military applications. Mobile equipment applications include construction, forestry, delivery vehicles and municipal fleets (trash collection, snow plows, etc.), Marine applications include ship deck cranes.

The functional fluids of the present invention are useful in power generation hydraulic equipment such as electrohydraulic turbine control systems.

Furthermore, the functional fluids of the present invention are useful as transformer liquids or quench oils.

The invention is illustrated in more detail below by examples and comparison examples, without intending to limit the invention to these examples,

EXAMPLE 1

Metal Ion Concentration Measurement

Nickel stearate powder was mixed at 60° C. in 100N oil at 0.5% by weight concentration for 3 hours. The resulting solution was added to polyalkylmethacrylate-based PPD at various treat rates to make nickel ion concentration in each sample as indicated in Table I. The samples were then subjected to X-ray Fluorescence Spectroscopy (XRF) to measure concentration of the metal ion. The measured metal ion concentrations match well with the calculated input concentration (Table I)

TABLE I

Comparison of Calculated Input Nickel Concentration with Measured Values

| Sample | Calculated Ni Content (ppm) | Experimental Ni Content (ppm) |
|---|---|---|
| 1 | 47 | 44 |
| 2 | 23 | 27 |
| 3 | 471 | 458 |

EXAMPLE 2

Performance of the Traced Functional Fluids

The presence of the organometallic tracer causes no adverse effect on the performance of additives, such as pour point depressant. In a 5W-30 engine oil formulations low temperature properties such as MRV/TP-1 viscosity, Scanning Brookfield viscosity and gel index remains in the same range regardless the presence of nickel based tracers. The results of low temperature properties are shown in Table II.

TABLE II

Performance comparision with Nickel Stearate in SAE 5W-30 Formulation

| | BLEND # | | | |
|---|---|---|---|---|
| | 0 W/O | 1 Ni Stearate | 2 Ni Stearate | 3 Ni Stearate |
| TREATRATE, wt % | — | 0.0001 | 0.0002 | 0.0003 |
| TP-1@−35° C. VISCOSITY, P | 232 | 233 | 232 | 234 |
| YIELDSTRESS, Pa | 0 | 0 | 0 | 0 |
| SBT | | | | |
| ° C.@30,000 cP | −32.13 | −31.86 | −31.85 | −31.75 |

TABLE II-continued

| Performance comparision with Nickel Stearate in SAE 5W-30 Formulation | | | | |
|---|---|---|---|---|
| | BLEND # | | | |
| | 0 W/O | 1 Ni Stearate | 2 Ni Stearate | 3 Ni Stearate |
| GEL INDEX | −33.8/6.8 | −33.3/7.5 | −33.2/7.6 | −32.2/7.2 |
| cP@−25° C. | 7,119 | 7,231 | 7,280 | 7,275 |

The invention claimed is:

1. A method for controlling the quality of a functional fluid, comprising;

adding one or more metal compounds to a polymer, to obtain a mixture;

combining said mixture with a functional fluid;

measuring the concentration of the metal compound in the functional fluid; and comparing the expected concentration of the metal compound with the measured concentration;

wherein the polymer comprises units derived from monomers selected from acrylate monomers, methacrylate monomers, fumarate monomers and/or maleate monomers.

2. The method according to claim 1, wherein the functional fluid is a lubricant or a hydraulic fluid.

3. The method according to claim 1, wherein the metal compound comprises an element selected from the group consisting of bismuth (Bi), cesium (Cs), cobalt (Co), manganese (Mn), neodymium (Nd), nickel (Ni), strontium (Sr), zirconium (Zr) and mixtures thereof.

4. The method according to claim 1, comprising adding to said functional fluid at least one metal compound according to the formula:

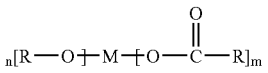

wherein M is a metal atom, R is an alkyl group having 8 to 30 carbon atoms, n is an integer from 0 to 4, and m is an integer from 0 to 4, wherein n+m is at least 1.

5. The method according to claim 1, wherein the at least one metal compound is present in an amount of 10 to 500 ppm.

6. The method according to claim 1, wherein the functional fluid comprises 0.00001% by weight to 0.01% by weight of one or more metal compounds.

7. The method according to claim 1, wherein at least two different metal compounds are added to a functional fluid.

8. The method according to claim 1, wherein the polymer has a weight average molecular weight in the range of 5000 to 1000000 g/mol.

9. The method according to claim 1, wherein the polymer is a viscosity index improver and/or a pour point depressant.

10. The method according to claim 1, wherein the polymer is a polyalkylmethacrylate polymer.

11. The method according to claim 1, wherein the polymer is obtained by polymerizing olefinically unsaturated monomers comprising at least one of:

a) ethylenically unsaturated monomers of one or more ethylenically unsaturated ester compounds of formula (II)

(II)

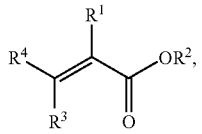

where R1 is hydrogen or methyl, R2 is a linear or branched alkyl residue with 1-6 carbon atoms, R3 and R4 independently represent hydrogen or a group of the formula COOR', where R' is hydrogen or a alkyl group with 1-6 carbon atoms, and b) ethylenically unsaturated monomers of one or more ethylenically unsaturated ester compounds of formula. (II)

(III)

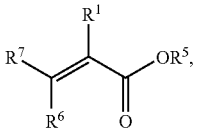

where R1 is hydrogen or methyl, R5 is a linear or branched alkyl residue with 7-40 carbon atoms, R6 and R7 independently are hydrogen or a group of the formula —COOR", where R" is hydrogen or an alkyl group with 7-40 carbon atoms.

12. The method according to claim 1, wherein the polymer is obtained by polymerizing a mixture comprising vinyl monomers containing aromatic groups.

13. The method according to claim 1, wherein the polymer has a molecular weight in the range of 10000 to 500000 g/mol.

14. The method according to claim 1, wherein the fluid comprises 0.1 to 50% by weight of the polymer.

15. The method according to claim 1, wherein the fluid comprises at least two polymers having a different monomer composition.

16. The method according to claim 1, wherein said functional fluid comprises at least one member selected from the group consisting of a mineral oil, a synthetic oil, and a biologically sourced oil.

17. The method according to claim 1, wherein the polymer has a chelating group.

18. The method according to claim 1, wherein the metal compound is not otherwise present in the functional fluid.

19. A method for controlling the quality of a functional fluid, comprising:

adding one or more metal compounds to a polymer, to obtain a mixture;

combining said mixture with a functional fluid;

measuring the concentration of the metal compound in the functional fluid; and comparing the expected concentration of the metal compound with the measured concentration;

wherein the polymer is a polyalkylmethacrylate polymer.

20. A method for controlling the quality of a functional fluid, comprising:

adding one or more metal compounds to a polymer, to obtain a mixture;

combining said mixture with a functional fluid;

measuring the concentration of the metal compound in the functional fluid; and comparing the expected concentration of the metal compound with the measured concentration;

wherein the polymer is obtained by polymerizing olefinically unsaturated monomers comprising at least one of:

a) ethylenically unsaturated monomers of one or more ethylenically unsaturated ester compounds of formula (II)

(II)

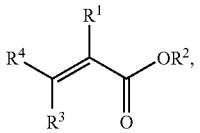

where R1 is hydrogen or methyl, R2 is a linear or branched alkyl residue with 1-6 carbon atoms, R3 and R4 independently represent hydrogen or a group of the formula COOR', where R' is hydrogen or a alkyl group with 1-6 carbon atoms, and b) ethylenically unsaturated monomers of one or more ethylenically unsaturated ester compounds of formula (II)

(III)

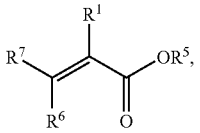

where R1 is hydrogen or methyl, R5 is a linear or branched alkyl residue with 7-40 carbon atoms, R6 and R7 independently are hydrogen or a group of the formula —COOR", where R" is hydrogen or an alkyl group with 7-40 carbon atoms.

21. A method for controlling the quality of a functional fluid, comprising:

adding one or more metal compounds to a polymer, to obtain a mixture;

combining said mixture with a functional fluid;

measuring the concentration of the metal compound in the functional fluid; and comparing the expected concentration of the metal compound with the measured concentration;

wherein the polymer is obtained by polymerizing a mixture comprising vinyl monomers containing aromatic groups.

22. A method for controlling the quality of a functional fluid, comprising:

adding one or more metal compounds to a polymer, to obtain a mixture;

combining said mixture with a functional fluid;

measuring the concentration of the metal compound in the functional fluid; and comparing the expected concentration of the metal compound with the measured concentration;

wherein the polymer has a chelating group.

* * * * *

UNITED STATES PATENT AND TRADEMARK OFFICE

CERTIFICATE OF CORRECTION

PATENT NO. : 7,553,673 B2
APPLICATION NO. : 11/559009
DATED : June 30, 2009
INVENTOR(S) : Bernard Kinker et al.

It is certified that error appears in the above-identified patent and that said Letters Patent is hereby corrected as shown below:

Column 1, line 43, "at least one metal compounds" should read --at least one metal compound--;
line 58, "in Ulimann's" should read --in Ullmann's--;
line 63, "Mineral oils axe well" should read --Mineral oils are well--;
Column 2, line 26, "dance with DIN 51 378," should read --dance with DIN 51 378.--;
Column 3, line 47, "aryl substituents, Dialkyl" should read --aryl substituents. Dialkyl--;
line 58, "acid Or poly" should read --acid or poly--;
Column 4, line 15, "der Technisehen Chemie," should read --der Technischen Chemie,--;
line 16, "Urban & Schwarenber" should read --Urban & Schwarzenber--;
line 35, "3,4-tetra-ethylpentanoic" should read --3,4-tetramethylpentanoic--;
line 38, "3,5,5-trimethylhexanoic, acid;" should read --3,5,5-trimethylhexanoic acid;--;
line 39, "9 octadecenoic acid," should read --9-octadecenoic acid,--;
line 65, "carbon is atoms." should read --carbon atoms.--;
Column 5, line 50, "5-ethyloctadccyl," should read --5-ethyloctadecyl,--;
Column 6, line 18, "inductively Couples Plasma" should read --Inductively Couples Plasma--;
Column 8, line 22, "having from L6 to 30 carbon" should read --having from 16 to 30 carbon--;
line 37, "Component (e) comprises" should read --Component (c) comprises--;
line 58, "branched alkenyl or alynyl groups" should read --branched alkenyl or alkynyl groups--;
line 62, "for example $C_2$=CCI-," should read --for example $CH_2$=CCI-,--;
Column 10, line 8, "2 dimethylphosphinomethyl(meth)acrylate," should read --2-dimethylphosphinomethyl(meth)acrylate,--;
line 11, "dipropylmethacryloyl phosphates" should read --dipropylmethacryloyl phosphate,--;
line 40, "3-vinylpyrrolidone" should read --3-vinylpyrrolidine--;
Column 11, line 66, "of the ATRRP" should read --of the ATRP--;
Column 12, line 53, "as an upper limit," should read --as an upper limit.--;

Signed and Sealed this
Twentieth Day of December, 2011

David J. Kappos

David J. Kappos
*Director of the United States Patent and Trademark Office*

Column 13, line 21, “comprises Units derived from,” should read --comprises units derived from--;
line 57, “BP additives,” should read --EP additives,--;
Column 14, line 5, “snow plows, etc.),” should read --snow plows, etc.).--;
line 46, “oil formulations low” should read --oil formulation, low--.